United States Patent [19]

Kasugai

[11] Patent Number: 4,486,062

[45] Date of Patent: Dec. 4, 1984

[54] WATERPROOF CONNECTOR

[75] Inventor: Masakuni Kasugai, Suzuka, Japan

[73] Assignee: Tokai Electric Wire Company, Ltd., Japan

[21] Appl. No.: 425,174

[22] Filed: Sep. 28, 1982

[30] Foreign Application Priority Data

Nov. 30, 1981 [JP] Japan ..... 56-177993

[51] Int. Cl.[3] ..... H01R 13/62

[52] U.S. Cl. ..... 339/91 R; 339/94 M

[58] Field of Search ..... 339/94, 91; 285/379, 285/DIG. 22

[56] References Cited

U.S. PATENT DOCUMENTS

| | | | |
|---|---|---|---|
| 3,544,119 | 12/1970 | Glover | 285/379 |
| 3,827,734 | 8/1974 | Brown | 285/379 |
| 3,924,881 | 12/1975 | O'Connor | 285/379 |
| 4,174,859 | 11/1979 | Houghton | 285/379 |
| 4,310,211 | 1/1982 | Bunnell et al. | 339/94 R |
| 4,395,085 | 7/1983 | Inoue | 339/94 R |

FOREIGN PATENT DOCUMENTS

| | | |
|---|---|---|
| 5546827 | 9/1978 | Japan . |
| 5568070 | 11/1978 | Japan . |

*Primary Examiner*—Eugene F. Desmond
*Assistant Examiner*—David L. Pirlot
*Attorney, Agent, or Firm*—Harness, Dickey & Pierce

[57] ABSTRACT

A waterproof electric connector for use in electric wiring on automobile or the like. The connector has a male connector housing 2 and a female connector housing 1 having a hollow cylindrical portion 3 adapted to receive the male connector housing. A seal ring 28 made of rubber is mounted in the hollow cylindrical portion with its outer peripheral surface held in contact with the inner peripheral surface of the hollow cylindrical portion, and is latched and secured by a retainer ring 19 received by the hollow cylindrical portion. The connector further has a first locking means 20, 21; 15, 18 for locking the retainer ring when the latter is mounted in the hollow cylindrical portion and a second locking means 17; 31 for locking the male connector housing to the female connector housing when the male connector housing is inserted into the hollow cylindrical portion.

3 Claims, 4 Drawing Figures

WATERPROOF CONNECTOR

BACKGROUND OF THE INVENTION

1. Field of the Invention

The present invention relates to a waterproof connector suited to use in, for example, electric wiring in automobile.

2. Description of the Prior Arts

Hitherto, the waterproof seal in waterproof connectors for electric wiring has been achieved by an endless seal ring having a circular cross-section and made of an elastic material such as rubber, tightly clamped between the peripheral surfaces of the male and female connector housings at the juncture therebetween, because this type of sealing ring offers the following advantage. Namely, since this seal ring has a circular cross-section, this seal ring can make a close fit at its inner and outer peripheral surfaces to the outer peripheral surface of the male connector housing and the inner peripheral surface of the female connector housing respectively and, even if the connector housings are moved axially relatively to each other to cause a twisting deformation of the sealing ring, the sealing ring maintains close contact with the outer peripheral surface of the male connector housing and the inner peripheral surface of the female connector housing to keep good water-tightness of the seal.

A known waterproof connector of the kind described has an annular groove formed in the outer peripheral surface of the male connector housing and receiving the seal ring, the male connector being received by a hollow cylindrical portion of the female connector housing in such a manner that the seal ring makes a close contact at its outer peripheral surface with the inner peripheral surface of the cylindrical portion of the female connector housing. This known waterproof connector, however, suffers the following disadvantage. Namely, since the seal ring fitted around the outer peripheral surface of the male connector housing is exposed to the outside before fitting the male connector housing into the female connector housing, the seal ring is liable to be damaged when the connector is used, for example, in the assembling of wire harness of an automobile or the like and when the wire harnesses employing the connectors are mounted on the automobile. Clearly, any damage in the surface of the seal ring seriously deteriorates the water-tightness of the seal formed by the seal ring.

A waterproof connector, improved to obviate the above-described problem of the prior art, is disclosed in Japanese Utility Model Laid-Open No. 46827/1980 laid open to public inspection on Mar. 27, 1980. In this improved waterproof connector, the seal ring is fitted in the hollow cylindrical portion of the female connector housing and is retained in the hollow cylindrical portion by means of a retainer ring inserted into the cylindrical portion. The male and female connector housings are adapted to be fitted to each other in this state. It will be seen that this arrangement obviates the problem of the prior art mentioned above because the seal ring is concealed by the hollow cylindrical portion of the connector housing and does not appear to the outside.

This improved waterproof connector, however, imposes the following new problem. Namely, when the male and female connector housings are fitted to each other, the male connector housing is locked by the retainer ring and is fixed to the female connector housing through the lock provided by the retainer ring. Since the male and female connector housings are fixed to each other indirectly through the retainer ring, the fit between two connector housings tends to become loose. Another problem is that, when the male and female connector housings are separated from each other, the retainer ring is withdrawn from the female connector housing following the male connector housing and this withdrawal of the retainer ring is often accompanied by the withdrawal of the seal ring undesirably.

SUMMARY OF THE INVENTION

Accordingly, an object of the invention is to provide waterproof connector improved to ensure that the seal ring is not exposed to the outside but securely held in the right place within the female connector housing when both connector housings are separated and to prevent the fitting between two housing parts from becoming loose, thereby to overcome the above-described problems of the prior arts.

To this end, according to the invention, there is provided a waterproof connector comprising: a male connector housing; a female connector housing having a hollow cylindrical portion for receiving the male connector housing, the hollow cylindrical portion having a first inner peripheral surface portion of a small diameter adjacent to the bottom thereof, a second inner peripheral surface portion of an intermediate diameter connected to the first inner peripheral surface portion through a first annular step, and a third inner peripheral portion formed between the open end of the hollow cylindrical portion and the second inner peripheral surface portion and connected to the latter through a second annular step; a seal ring adapted to be mounted in the female connector housing with its outer peripheral surface in engagement with the second inner peripheral surface portion; a retainer ring adapted to be inserted into the third inner peripheral surface portion so as to latch and hold the seal ring; the male connector housing having a small-diameter portion adapted to fit, when the male connector housing is inserted into the hollow cylindrical member, into the first inner peripheral surface portion through the inner side of the retainer ring and the seal ring, and a large-diameter portion adapted to be positioned within the third inner peripheral surface portion when the male connector housing is received by the female connector housing: a first locking means adapted to fix the retainer ring to the female connector housing when the retainer ring is mounted in the third inner peripheral surface portion; and a second locking means adapted to fix the male connector housing to the female connector housing when the male connector housing is received by the hollow cylindrical portion.

The above and other objects, features and advantages of the invention will become clear from the following description of the preferred embodiments taken in conjunction with the accompanying drawings.

DETAILED DESCRIPTION OF THE PREFERRED EMBODIMENT

Figure 1:
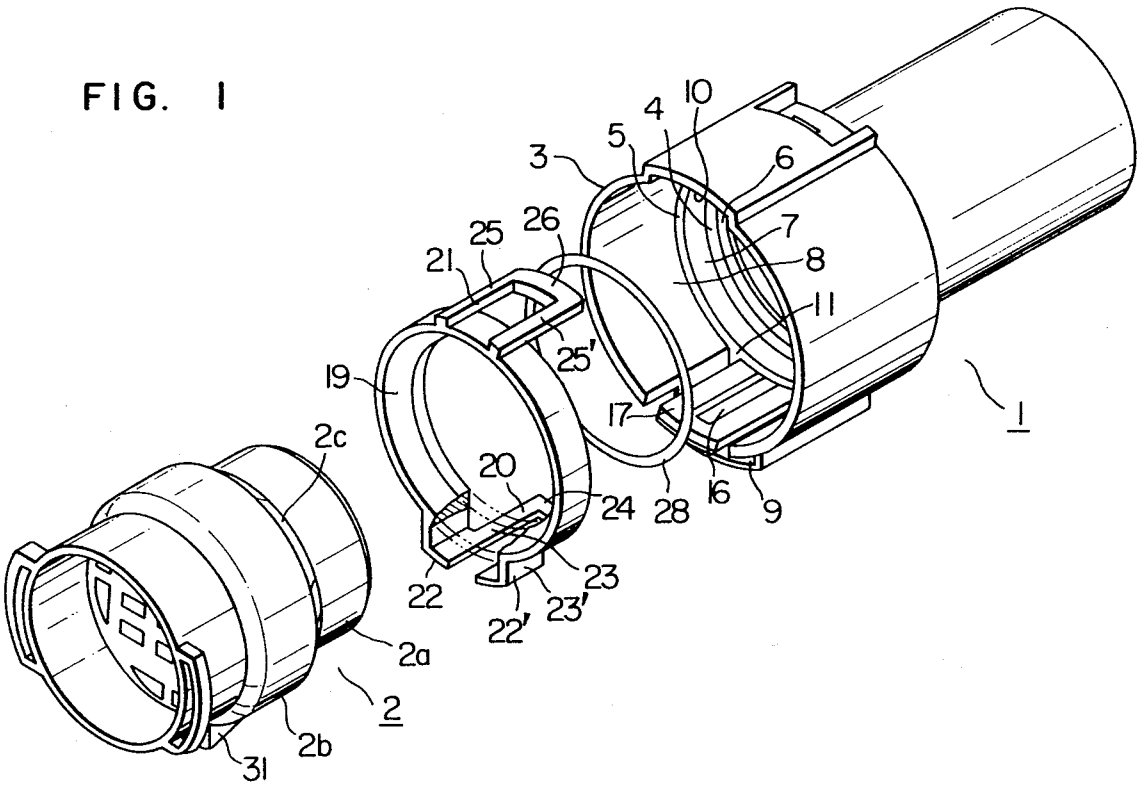
FIG. 1 is an exploded perspective view of a waterproof connector of an embodiment of the invention, showing the male connector housing, female connector housing, retainer ring and a seal ring in the state before assembling.

Referring to FIGS. 1 thru 4, a reference numeral 1 denotes a female connector housing adapted to receive a male terminal (not shown). The female connector housing 1 has a hollow cylindrical portion 3 adapted to receive a male connector housing 2. The hollow cylindrical portion 3 has a first inner peripheral surface portion 6 of a small diameter adjacent to the bottom thereof, i.e. the right-side end of the hollow cylindrical portion 3 as viewed in FIGS. 1 thru 3, a second inner peripheral surface portion 7 of an intermediate diameter and connected to the first inner peripheral surface portion 6 through a first annular step 4, and a third inner peripheral surface portion 8 between the open end of the inner hollow cylindrical portion 3 and the second inner peripheral surface portion 7 and connected to the latter through a second annular step 5.

The third inner peripheral surface portion 8 has two recesses 9 and 10 which extends in the axial direction of the female connector housing 1 past the positions adjacent to the radially outer ends of the first and second annular steps 4 and 5. One 9 of the recesses has a depth greater than that of the other 10.

Figure 2:
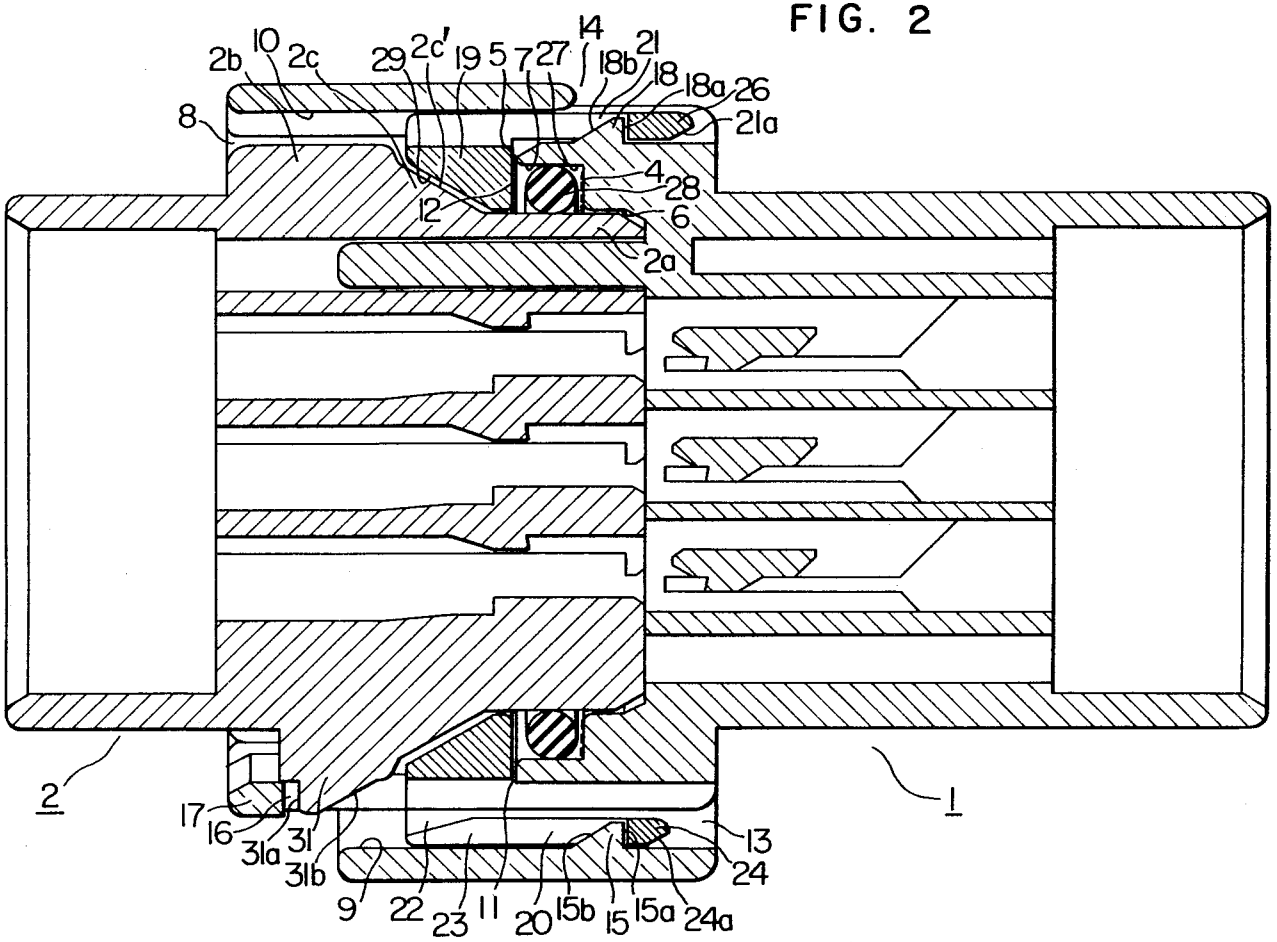
FIG. 2 is a sectional view of the waterproof connector shown in FIG. 1, in the state after assembling of the male and female connectors, retainer ring and the seal ring.
Figure 3:
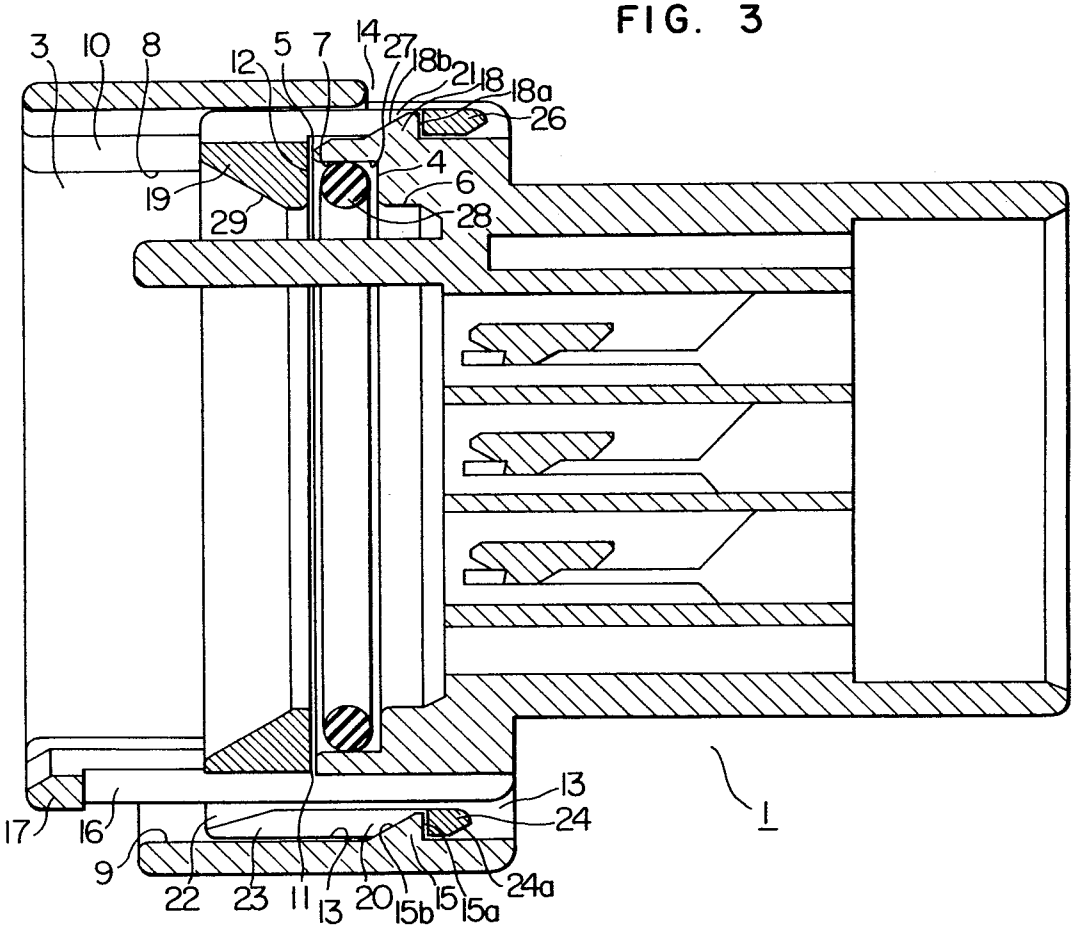
FIG. 3 is a sectional view of the waterproof connector shown in FIG. 2 with the male connector housing removed therefrom.
Figure 4:
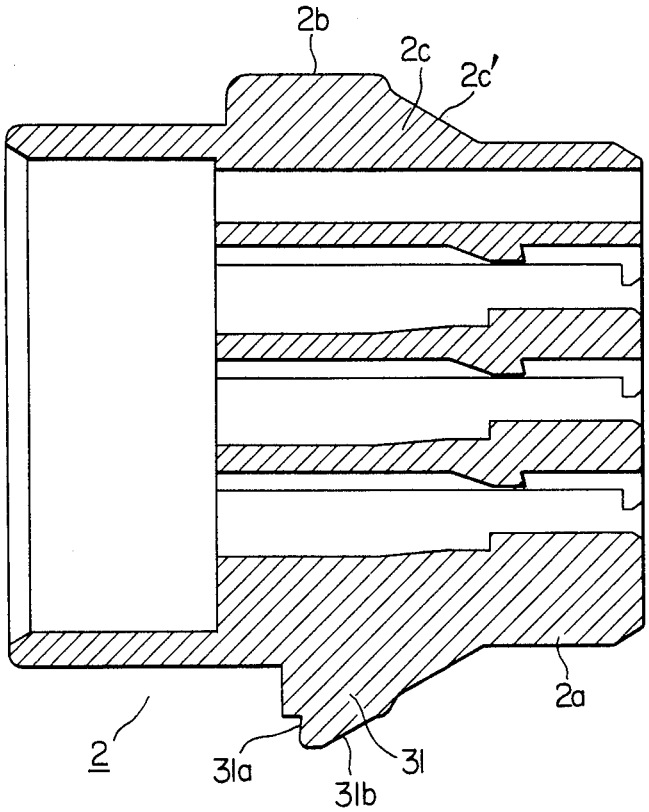
FIG. 4 is a sectional view of a male connector housing.

As will be clearly seen from FIGS. 2 and 3, the right-side ends of the recesses 9 and 10 are opened to the outside as at 13 and 14.

The recess 19 is provided at its portion near the right end thereof with an inward radial projection 15. A resilient retainer member 17 having an aperture 16 formed therein extends from the surface 11 of the second annular step 5 adjacent to the open end of the hollow cylindrical portion 13 in the axial direction of the female connector housing toward the open end of the hollow cylindrical portion 3 in such a manner as to oppose to the recess 9 with a small gap left therebetween. As will be clearly seen from FIGS. 2 and 3, the aforementioned projection 15 has a right-side end surface 15*a* protruding from the recess 9 radially inwardly and substantially perpendicularly to the recess 9, and an inclined surface 15*b* which extends leftwardly and downwardly from a position adjacent to the inner end edge of the above-mentioned end surface 15*a*.

The left or free end of the retainer member 17 extends leftwardly beyond the left end of the recess 9 and is exposed to the outside.

A projection 18 is formed on the portion of the outer peripheral surface of the hollow cylindrical portion 3 spaced by a small distance rightwardly from the recess 10 as viewed in FIGS. 1 thru 3. The projection 18 has a right-side end surface 18*a* which protrudes radially outwardly from the outer periphery of the hollow cylindrical portion 3 substantially perpendicularly thereto and an inclined surface 18*b* extending downwardly and leftwardly as viewed in FIGS. 2 and 3 from the portion adjacent to the outer end edge of the right-side end surface 18*a*.

A retainer ring 19 has an outside diameter substantially equal to the inside diameter of the third inner peripheral surface portion 8 of the hollow cylindrical portion 3 and an inside diameter substantially equal to the inside diameter of the first inner peripheral surface portion of the hollow cylindrical portion 3. The retainer ring 19 is provided with a pair of retainer arms 20, 21 extending in the axial direction from the outer peripheral surface thereof.

The retainer arm 20 includes a pair of walls 22, 22′ projected from the outer peripheral surface of the retainer ring 19 and spaced from each other by a distance slightly greater than the breadth of the retainer member 17 on the female connector housing 1. The retainer arm 20 further has a pair of supporting tab portions 23, 23′ extended from respective walls 22, 22′ and a bridging portion 24 which bridges the free ends of the supporting tab portions 23, 23′. The end surface of the bridging portion 24 is tapered radially inwardly toward the free end as at 24*a*.

On the other hand, the retainer arm 21 has a pair of supporting tab portions 25, 25′ extended from the outer peripheral surface of the retainer ring 19 and a bridging portion 26 bridging the free ends of the supporting tab portions 25, 25′. The inner surface of the bridging portion 26 is tapered radially outwardly toward the free end as at 21*a*.

The retainer ring 19 is adapted to fit in the third inner peripheral surface portion 8 of the hollow cylindrical portion 2 of the female connector housing and, in the received state, cooperates with the first annular step 4 and the second inner peripheral surface portion 7 in defining an annular recess 27. As the retainer ring 19 is inserted into the hollow cylindrical portion 3, the retainer arm 20 is slid into the space between the recess 9 and the retainer member 17, while the retainer arm 21 is received by the recess 10. As the retainer ring 19 is driven deeper into the hollow cylindrical portion, the tapered surfaces 24*a*, 21*a*, slide along the aforementioned tapered surfaces 15*b*, 18*b* to move over these tapered surfaces, and finally the retainer ring 19 is retained at its bridging portions 24, 26 by the projections 15, 18 through a snapping action. In this final state, the retainer member 17 extends through the gap between the retainer arm 20 and the outer peripheral surface of the retainer ring 19. Thus, the retainer ring 19 is securely held in the hollow cylindrical portion 3 through the contact with the second annular step 5 and the engagement between the retainer arms 20, 21 and the projections 15, 18.

An endless seal ring 28 having a circular cross-section and made of a material such as rubber is received by the aforementioned annular recess 27 with its outer peripheral surface portion 7 and its inner periphery projected slightly inwardly from the recess 27. The seal ring 28 is fitted to the second inner peripheral surface portion 7 before the first retainer ring 19 is inserted into the hollow cylindrical portion 3 and is fixed there as the retainer ring 19 is inserted.

The inner peripheral surface of the retainer ring 19 is gradually diverged in the direction opposite to the direction in which the retainer arms 20, 21 extend, so as to form a tapered guide surface 29.

The male connector housing 2 is adapted to receive a female terminal (now shown) which is to be connected to a male terminal (now shown) accommodated by the female connector housing 1. This male connector housing 2 includes a small-diameter portion 2*a* adapted to fit in the first inner peripheral surface portion 6 of the hollow cylindrical portion 3, a large diameter portion 2*b* adapted to positioned within the third inner peripheral surface portion 8 when the small-diameter portion 2*a* fits in the above-mentioned portion 6, and an large-diameter portion 2*c* and having a tapered outer peripheral surface 2*c*'.

The male connector housing 2 is adapted to be inserted into the hollow cylindrical portion 2 through the inner side of the retainer ring 19 and the seal ring 18, after the mounting of the seal ring 28 and the retainer ring 10 in the female connector housing, as shown in FIG. 3. The guide surface 29 of the retainer ring 19 serves as a guide for smoothing the insertion of the male connector housing 2. When the male connector housing 2 is correctly received by the hollow cylindrical portion 3, the small-diameter portion 2*a* of the male connector housing fits in the first inner peripheral surface portion 6 of the female connector housing with its outer peripheral surface held in close contact with the inner periphery of the seal ring 28 thereby to keep the seal ring 28 in compressed state, so that a right seal is achieved by the seal ring 28. When the male connector housing is fitted in the female connector housing, the tapered outer peripheral surface 2*c*' of the male connector housing 2 is received by the guide surface 29 of the retainer ring 19.

A projection 31 is formed on the outer peripheral surface 2*b* of the large-diameter portion of the male connector housing 2. The projection 31 has a left end surface 31*a* (see FIGS. 2, 3 and 4) extending radially outwardly from the outer peripheral surface substantially perpendicularly to the latter and a tapered surface 31*b* which extends from the portion near the outer end edge of the left end surface 31*a* upwardly and rightwardly as viewed in FIGS. 2, 3 and 4. As stated above, when the male connector housing 2 is fitted to the female connector housing 1, the abovementioned projection 31 engages the aperture 16 of the retainer member 17 thereby to lock the male connector housing 2 and the female connector housing 1 to each other.

According to the arrangement described above, the undersirable damaging of the seal ring, which has been often experienced in the prior art structure during mounting of the wire harness using the connector on automobile or the like, is completely eliminated because the seal ring 28 is perfectly concealed within the female connector housing 1 in the state in which the seal ring 28 is fitted together with the retainer ring 19 in the female connector ring as shown in FIG. 3. Furthermore, the retainer ring 19 is locked to the female connector housing 1 through engagement between the retainer arms 20, 21 and the projections 15, 18 and, in the state shown in FIG. 2, the male connector housing 2 is locked to the female connector housing 1 through the engagement with the retainer member 17 and the projection 31. When the male connector housing 2 is withdrawn from the position shown in FIG. 2 after disengaging the aperture 16 of the retainer member 17 from the projection 31 by resiliently deflecting the left end of the retainer member 17 downwardly, the connector takes the state as shown in FIG. 3. In this state, the seal ring 28 and the retainer ring 19 are securely held within the female connector housing 1. Namely, there is no fear that the seal ring 28 and the retainer ring 19 are withdrawn together with the male connector ring when the latter is withdrawn. Furthermore, since the male connector housing is directly locked to the female connector housing through engagement between the projection 31 and the retainer arm 17, the undesirable loosening of the fit between two connector housings is suppressed as compared with the known arrangement disclosed in the aforementioned Japanese Utility Model Laid-Open No. 46827/1980.

Although the invention has been described through specific terms, it is to be noted here that various changes and modifications may be imparted thereto without departing from the spirit or scope of the invention which is limited solely by the appended claims.

What is claimed is:

1. A waterproof connector comprising:

a male connector housing;

a female connector housing having a hollow cylindrical opening for receiving said male connector housing, said hollow cylindrical opening having a first inner peripheral surface portion of a small diameter at the base of said cylindrical opening, a second inner peripheral surface portion of a diameter larger than said small diameter and connected to said first inner peripheral surface portion through a first annular step, and a third inner peripheral portion of a diameter larger than that of said second inner peripheral surface portion formed between the open end of said hollow cylindrical opening and said second inner peripheral surface portion and connected to the latter through a second annular step;

a seal ring mounted in said female connector housing with its outer peripheral surface in engagement with said second inner peripheral surface portion;

a retainer ring inserted into said third inner peripheral surface portion to latch and hold said seal ring;

said male connector housing having a small-diameter portion fitting into said first inner peripheral surface portion of said cylindrical opening of said female connector housing and a large-diameter portion positioned within said third inner peripheral surface portion when said male connector housing is received by said female connector housing;

said retainer ring having an opening therein formed to pass said male connector housing small-diameter portion and said seal ring being engaged with said male connector housing small-diameter portion for forming a seal therewith;

a first locking means on said retainer ring and said female connector housing for fixing said retainer ring to said female connector housing; and a second locking means on said male connector housing and said female connector housing for fixing said male connector housing to said female connector housing when said male connector housing is received by said hollow cylindrical portion.

2. A waterproof connector according to claim 1, wherein said third inner peripheral surface portion includes at least two recesses extending from the open end of said hollow cylindrical portion in the axial direction of said female connector housing and radially outwardly of said first and second annular steps, said first locking means includes at least two retainer arms projecting from said retainer ring integrally therewith and adapted to be positioned and fixed by the inner sides of said recesses.

3. A waterproof connector according to claim 2, wherein said second locking means includes a retainer member formed on said female connector housing and having an aperture and opposing to at least one of said recesses in said third inner peripheral surface portion and extending from the position of said second annular step in the axial direction of said female connector housing, and a projection projected from the outer peripheral surface of said large-diameter portion of said male connector housing and adapted to engage said aperture in said retainer member.

* * * * *